United States Patent [19]

Pugliese

[11] 4,016,822

[45] Apr. 12, 1977

[54] SEAM FOLDING AND PRESSING ATTACHMENT FOR SEWING MACHINES

[75] Inventor: Antonio Pugliese, Miami, Fla.

[73] Assignee: Shap, Inc., Opa Locka, Fla.

[22] Filed: Nov. 20, 1975

[21] Appl. No.: 633,854

[52] U.S. Cl. ..... 112/217; 38/8

[51] Int. Cl.[2] ..... D05B 27/00

[58] Field of Search ..... 112/217, 147, 153, 63; 38/10, 8, 9

[56] References Cited

UNITED STATES PATENTS

| | | | |
|---|---|---|---|
| 2,307,623 | 1/1943 | Gardner | 112/217 |
| 2,753,823 | 7/1956 | Judelson | 112/217 |
| 3,246,616 | 4/1966 | Korioth | 112/217 X |
| 3,478,451 | 11/1969 | Sigoda | 112/217 X |
| 3,659,537 | 5/1972 | Sigoda | 112/217 |

*Primary Examiner*—H. Hampton Hunter

*Attorney, Agent, or Firm*—Salvatore G. Militana

[57] ABSTRACT

An attachment for sewing machines for folding and pressing seam plies for sleeves, trousers and the like having a pair of endless belts or tapes between which the cloth being sewn is carried. After the seam has been sewn, the cloth is carried forwardly into the path of a V-shaped seam opening member which causes the seam plies to be separated, be positioned at right angle to the cloth and lie on either side of the seam in a common plane. Upon being carried further forwardly, the seam plies engages a seam folding member which guides and folds over the seam plies from their right angle position to a flattened position against the cloth whereby the seam plies lie in substantially the same plane as the two layers of cloth after which the heated rollers and a hot air blower presses the four layers of cloth in superimposed contact relation. A floating bow-like member positioned between the endless tapes supports the two layers of cloth as the seam is folded and permits the sewing of a seam to be sewn along both edges of a trouser leg portion.

10 Claims, 10 Drawing Figures

SEAM FOLDING AND PRESSING ATTACHMENT FOR SEWING MACHINES

BACKGROUND OF THE INVENTION

1. Field Of The Invention

This invention relates to sewing devices and is more particularly directed to an attachment for sewing machines upon sewing a seam on two overlapping portions of cloth, separate the seam plies, fold the seam plies flat upon the portions of cloth at the seam and presses same to set the folded seam plies so as to remain in a folded condition.

2. Description OF The Prior Art

Until quite recently, seams for trousers, shirts and the like were first sewn on sewing machines and then pressed on pressing machines. Because of the increased cost and time factor, seam folding and pressing attachments for sewing machines have been developed recently which sew a seam, fold the seam plies approximately 90° in a direction away from each other so as to lie in a plane and then press each of the seam plies in contact relation with the cloth from which the seam extends. However, the present attachments cannot sew and press a second seam along the two plies of cloth at a side opposite the seam already seamed as in trousers. The second seam has to be pressed by hand after being sewn. These attachments are very complicated, are expensive and do not fold the seam plies, so that when pressed remain in contact relation with the cloth from which the seam ply extends as occurs when pressed by hand or as a separate step of operation. The present invention contemplates avoiding the shortcomings of the conventional attachments for sewing machines by providing a sewing machine attachment which sews two plies of cloth, spreads the seam plies and folds them over onto the cloth from which ply extends to form four superimposed layers of cloth at the seam and which is capable of sewing and folding a second seam to form, for example, a trouser leg or shirt arm.

SUMMARY OF THE INVENTION

Therefore, a principal object of the present invention is to provide a sewing machine attachment which is capable of sewing a seam, folding the seam plies on the folded cloth and pressing the folded seams.

Another object of the present invention is to provide a sewing machine attachment operated by a single person who operates the sewing machine that progressively sews the seam as the attachment folds and presses the folded seams successively.

A further object of the present invention is to provide an attachment for sewing machines that folds and presses the pair of seams needed to form a trouser leg or coat sleeves.

A still further object of the present invention is to provide a sewing machine attachment which is simple in construction, inexpensive in cost and most effective to fold and press a seam as the seam is being sewn by the sewing machine.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFERRED EMBODIMENT

Figure 1:
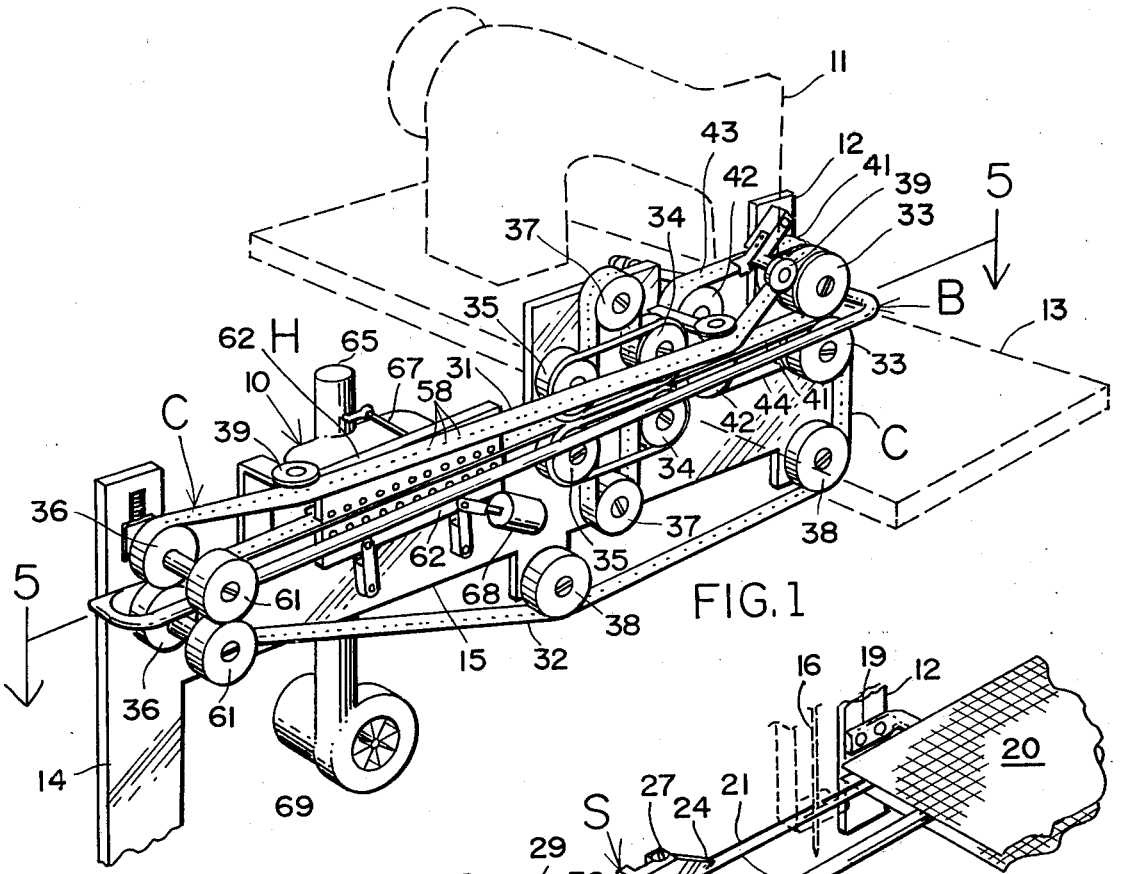
FIG. 1 is a perspective view of my seam folding and pressing attachment for sewing machines with the sewing machine shown by dotted lines.

Referring to the drawings wherein like numerals are used to designate similar parts throughout the several views, the numeral 10 refers to an attachment for folding and pressing a seam constructed in accordance with my invention and shown mounted onto its proper position on a sewing machine 11 which is indicated by dotted lines in FIG. 1. The attachment 10 is supported at its end portions by an L-shaped bracket 12 which is secured to the sewing machine table 13 and a foot member 14 extending to the floor from a wall frame member 15 on which the various mechanisms of my attachment 10 are mounted. The attachment 10 is so positioned on the sewing machine 11 that the needle 16 is found slightly rearwardly of the bracket 12. The cloth feeder normally found on the sewing machine 11 is disengaged since my attachment 10 controls the movement of the cloth along the device as is explained in detail hereinafter.

Figure 8:
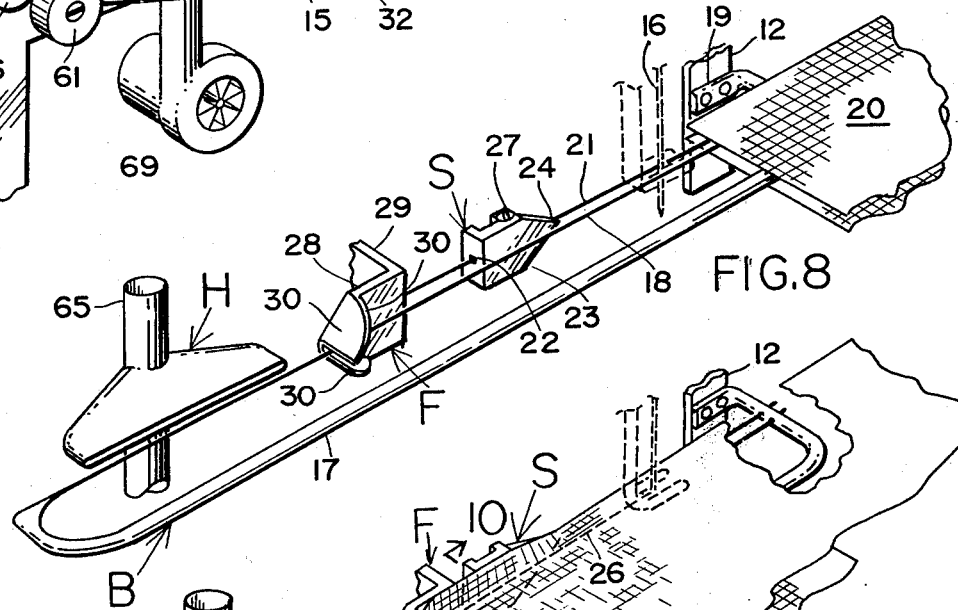
FIG. 8 is a perspective view of the floating cloth supporting mechanism with the seam spreading and folding devices shown.
Figure 9:
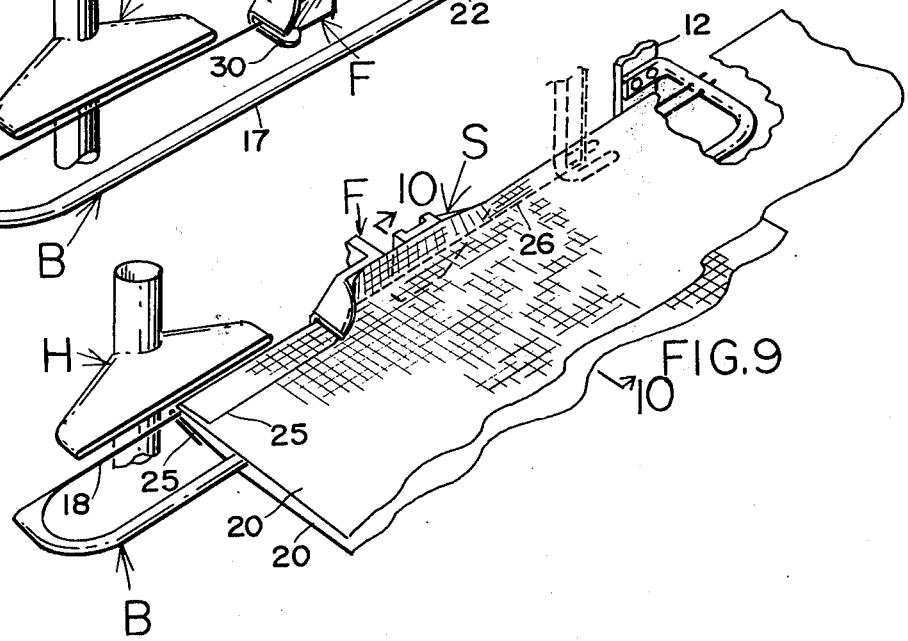
FIG. 9 is a similar view showing the manner of folding a seam by the mechanism.

Mounted on the bracket 12 is a floating bow B consisting of a C-shaped bar 17 across which a wire 18 extends and having an arm portion 19 secured to the bracket 12 for its only direct support. As best shown by FIGS. 8 and 9, the bow B supports the two plies of cloth 20 on which a seam 26 is first sewn by the needle 16, the seam plies are then opened and spread apart by a seam opening member S and later folded by a seam folding member F. Before the cloth 20 leaves my attachment 10, heating device H/and the pressing device P will heat and press the folded seams in position on the cloth after which the cloth 20 leaves the attachment. The cloth 20 is moved along the floating bow B by a conveying mechanism C which is explained in detail hereinafter.

There is a second wire 21 that extends from the floating bow 17 parallel and in close proximity to the wire 18 having its other end attached to the seam folding member F. The wire 21 extends through an opening 22 formed in the seam opening member S. The latter is free floating, resting and balanced on the wire 21 and consisting of a vertically disposed flat rectangular body portion 23 having a pointed forward end portion 24 which engages the two layers of cloth 20 at the seam 26 to spread the seam plies 25 apart. A set screw 27 threadedly mounted on the body portion 23 secures the seam opener S to the wire 21. At this position, the upper and lower seam plies 25 will lie in a vertical plane at right angle to that of the cloth 20. See FIGS. 8 and 9.

Continued rearward movement of the two layers of cloth 20 will bring the seam plies in contact relation with the seam folder F which consists of a flat vertically disposed body portion 28 having a leg portion 29 which is fastened to the wall member 15 for support. On the rear end portion of the body member 28 overlapping the wire 18 there is an upper and lower tab portion 30 extending at right angles to the body member 28 but at an oblique angle with each other extending in a direction toward each other. The tabs 30 are spaced from each other to permit the folded seam plies 25 to pass there between and be received by the heating and pressing devices H and P.

Figure 2:
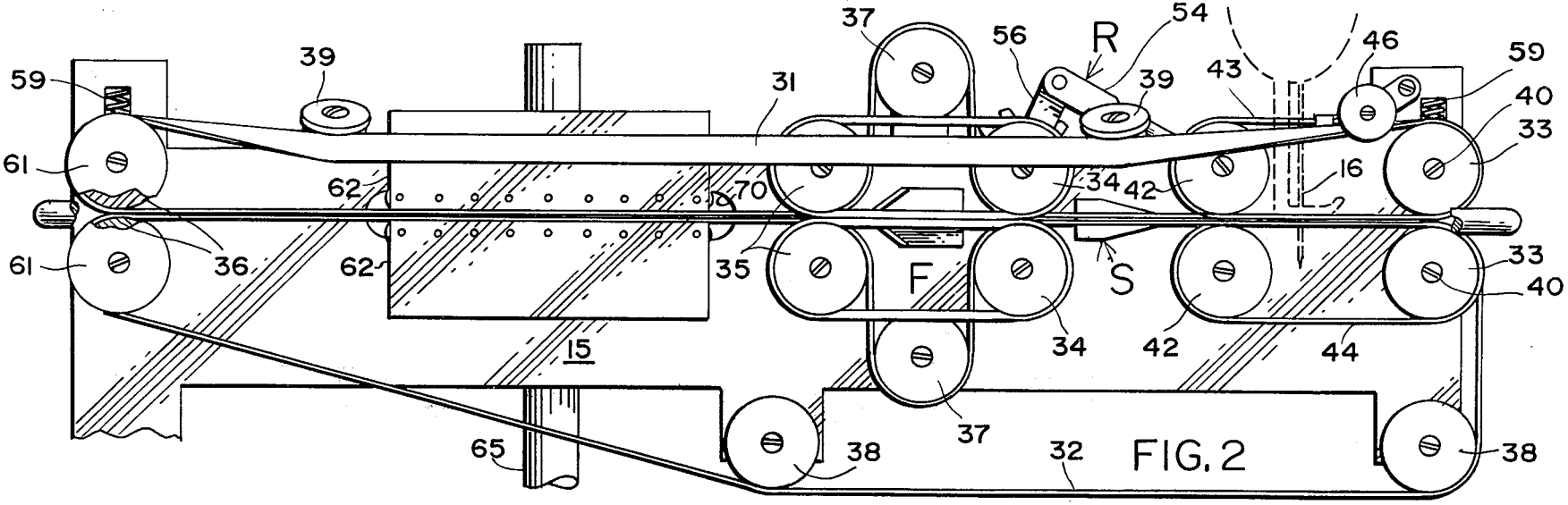
FIG. 2 is a side elevational view showing only the needle and head of the sewing machine.
Figure 5:
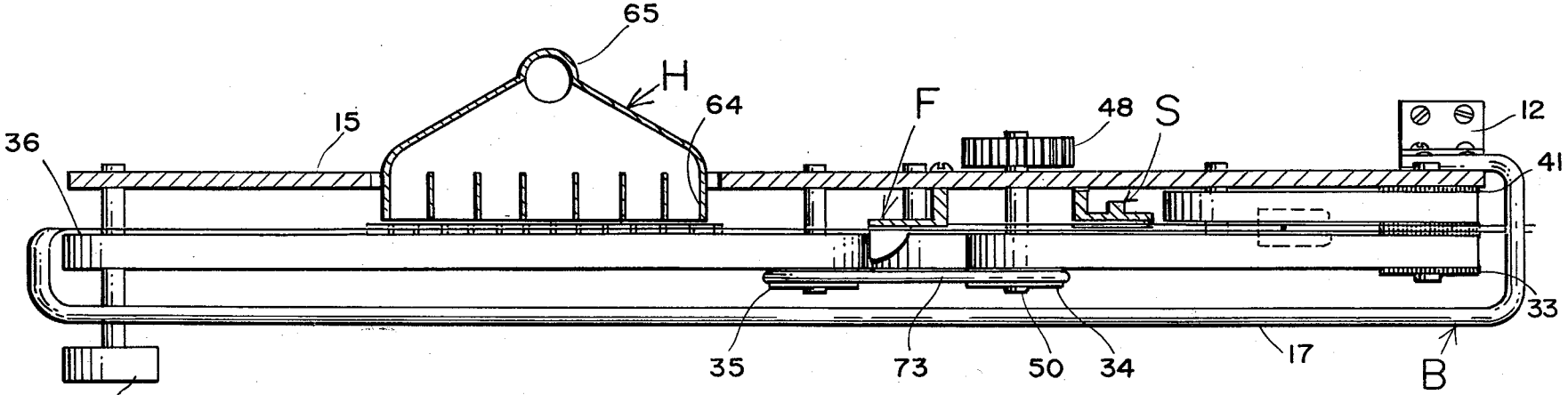
FIG. 5 is a horizontal cross sectional view taken along the line 5—5 of FIG. 1.

The movement of the two layers of cloth 20 along my attachment 10 is accomplished by the conveyor mechanism C consisting of a plurality of rollers or pulleys over which endless tapes or belts 31 and 32 are positioned. The tapes 31 and 32 are close together with the two layers of cloth held between the tapes 31 and 32 and move in a horizontal plane along the attachment 10 when moving the two layers of cloth rearwardly of the attachment 10. Rotatably mounted above and below the tapes 33 and 32 in vertical alignment are rollers 33, 34, 35 and 36 rotatably mounted on the frame wall 15. In order to provide space for the seam folder F, rollers 37 are mounted in a plane removed from those of the rollers 33, 34, 35 and 36 as best shown by FIG. 2 compelling the tapes 31 and 32 to travel away from the bow B at this position. The return rollers 38, 38 engage the lower tape 32 and are mounted below the rollers 35 and 33 in vertical coplanar alignment with the rollers 33, 34, 35 and 36. The return portion of the upper tape 31 is not positioned in alignment with the rollers 33, 34, 35 and 36 but instead is angled out of alignment by rollers 39, 39 whose axis of rotation is set at an oblique angle to the horizontal thereby compelling that portion of the tape 31 to lie in a vertical plane beyond that of the rollers 33, 34, 35 and 36. After the tape 31 moves off the forwardly positioned oblique roller 39 the tape 31 assumes a horizontal position and is received on the roller 33.

On the inner portion of shafts 40 on which the rollers 33 are mounted, are an upper and lower second roller 41 in vertical alignment with a second pair of rollers 42 rotatably mounted on the frame wall 15 adjacent the seam opener S. Endless tapes 43 and 44 that engage the upper and lower rollers 41, 42 have the function of engaging the outer edge portions of the two layers of cloth 20 prior to being sewn together and after the seam 26 has been sewn until the cloth arrives at the seam opener S while the tapes 31 and 32 engage the cloth 20 on the inside of the seam 26 all during the travel of the cloth 20 on the attachment 10. An arm 45 pivotally mounted to the wall frame 15 carries a wheel 46 having a rim thereon for engaging the outer edge of the upper tape 31 to direct it properly onto the roller 33. Also mounted on the arm 45 is a flanged member 47 that engages the tape 43 to maintain the latter properly on the roller 41.

Figure 3:
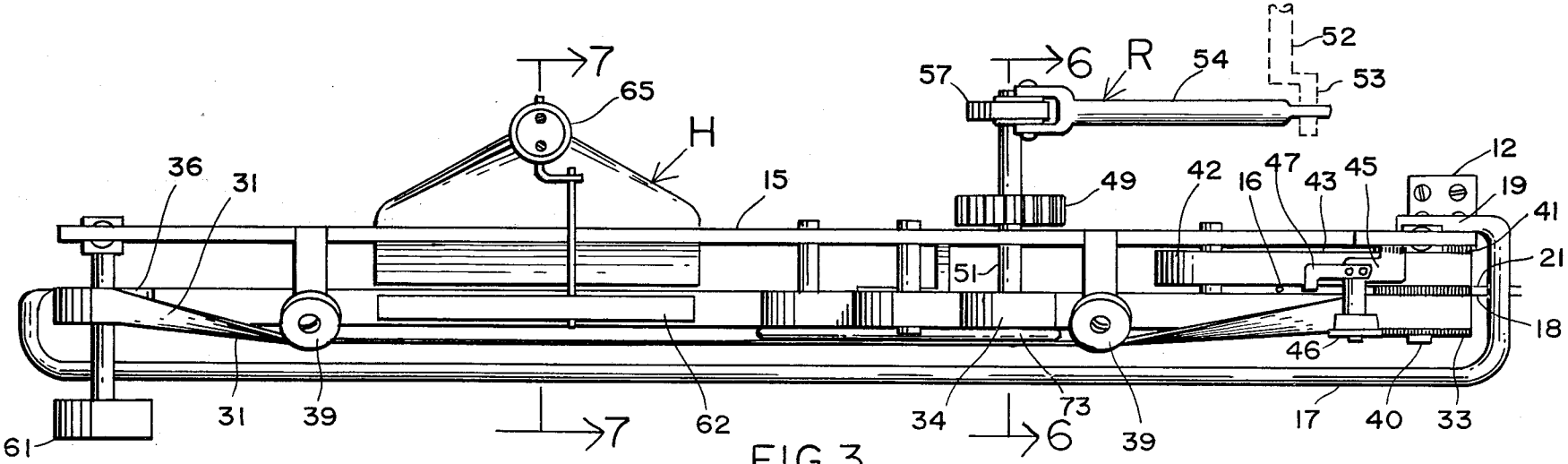
FIG. 3 is a top plan view showing only the needle of the sewing machine.

Inasmuch as the sewing machine cloth feeder has been disengaged, the two layers of cloth 20 fed between the tapes 31 and 32 at the position of the rollers 33, 41 are advanced by the movement of the tapes 31, 32. The mechanism that compels the tapes 31 and 32 to move about their respective rollers consist of gears 48 and 49 that are mounted on shafts 50 and 51 respectively on which the rollers 34 are mounted. The gears 48 and and 49 are in mesh engagement so that movement of the gears 48 and 49 and the ultimate movement of the tapes 31 and 32 will be in unison. Power is transmitted from a take-off shaft 52 (shown by dotted lines in FIG. 3) that is a part of the sewing machine 11 and is provided with a cam pin 53 to which a ratchet mechanism R is connected.

Figure 4:
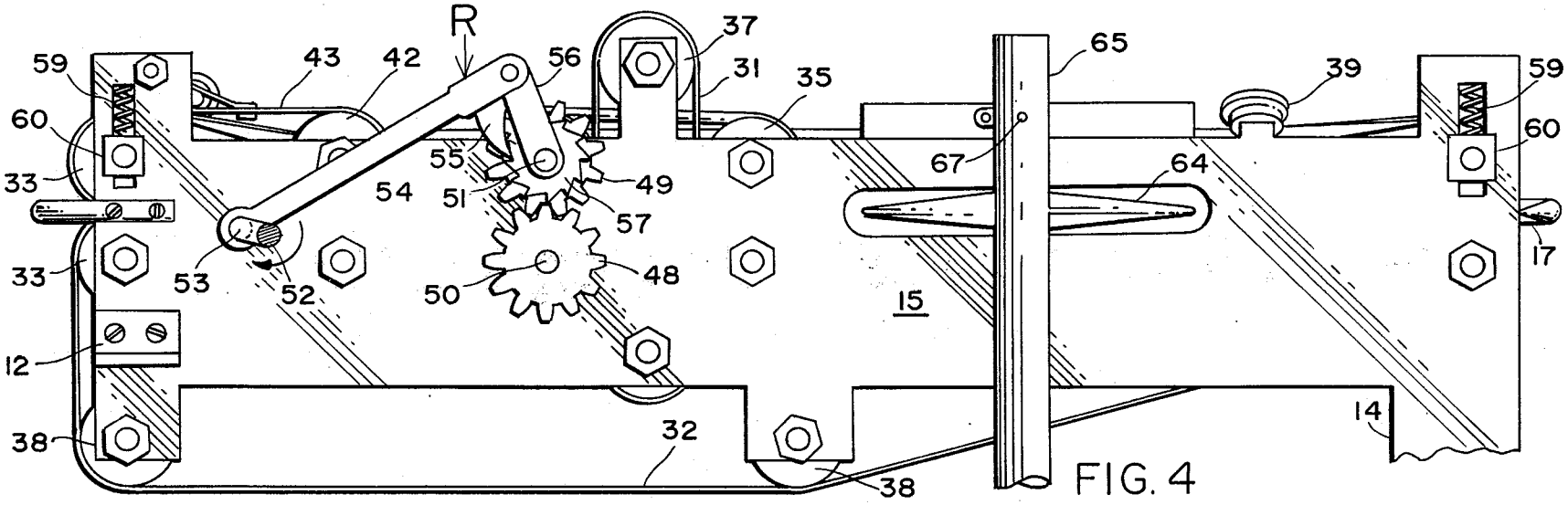
FIG. 4 is an elevational view of the side opposite that shown by FIG. 2.
Figure 6:
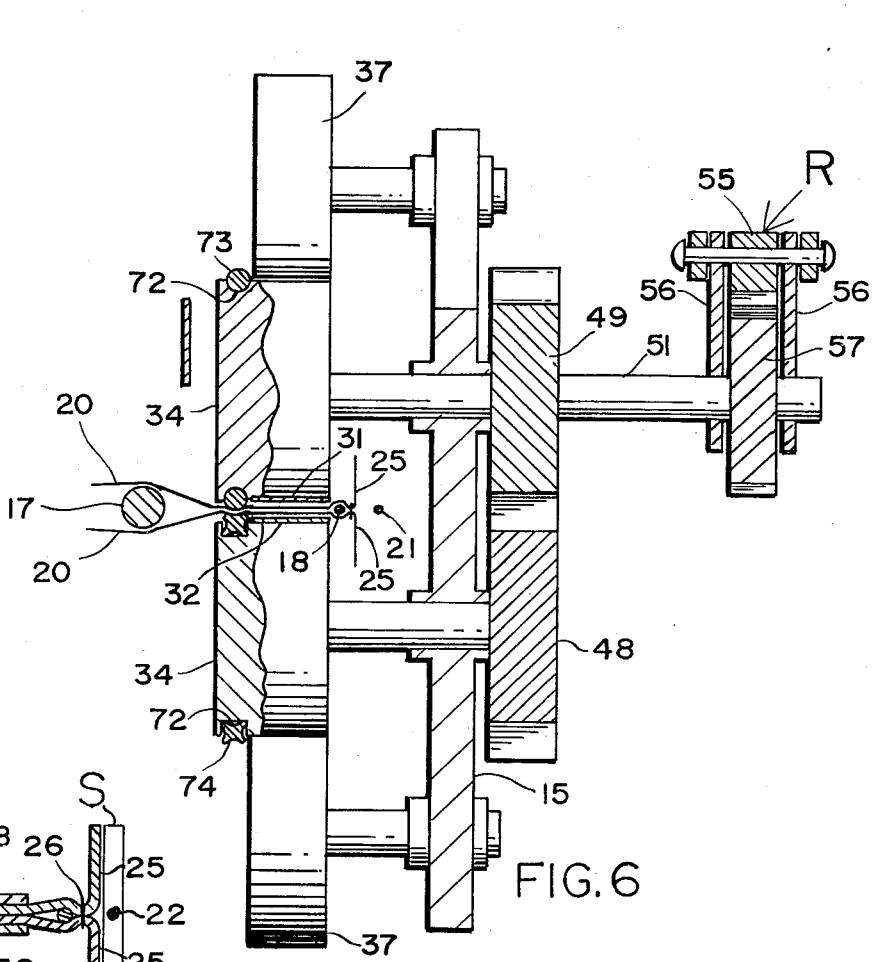
FIGS. 6 and 7 are cross sectional views taken along the lines 6—6 and 7—7 respectively of FIG. 3.
Figure 10:
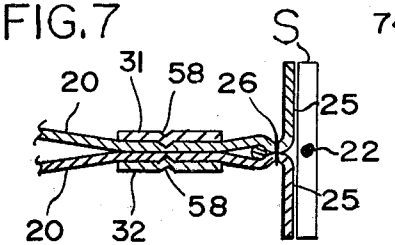
FIG. 10 is a cross sectional view taken along the line 10—10 of FIG. 9 to indicate the position of the seam plies as effected by the seam opener.

The ratchet device R consisting of a lever 54 connected at one end to the cam pin 53 and to a pawl 55 and arm 56; the other end of the arm 56 being secured to the shaft 51 on which a ratchet wheel 57 is mounted. The latter is mounted on an extension to the shaft 51 to which the roller 34 is secured. When the sewing machine 11 is operated, the shaft 52 and cam pin 53 will rotate to cause the arm 54 to oscillate back and forth. The ratchet pawl 55 will advance the gears 57, 49 and 48 one step for each revolution of the shaft 52 thereby causing the tapes 31 and 32 to advance rearwardly as it carries along the cloth 20 therebetween. In order to prevent the possibility of slippage between the cloth and tapes 31 and 32, the tapes 31 and 32 are formed with indentations 58 along their full length. The tapes 31 and 32 may be coated with an abrasive material, if need be, to prevent the cloth 20 from slipping. Also, in order to accommodate cloths of varying thicknesses, the shafts of the rollers 33 and 36 are mounted in bearing housings 60 that are slidably mounted against a spring force 59 as best shown by FIG. 4. The shafts on which rollers 36 are mounted are extended to receive rubber coated rollers 61 which engage the cloth 20 at a position removed from the seam to compel the cloth to move evenly along the attachment 10 while under the influence of the moving tapes 31, 32. To assure the movement of both layers of cloth 20 in unison with movement of the tapes 31 and 32, the upper and lower rollers 34 are of greater width than the other rollers hereinabove described so that the rollers 34 engage the cloth 20 as well as the tapes 31 and 32. At the position beyond outer edges of the tapes 31 and 32, both of the rollers 34 are provided with a peripheral groove 72. In the upper roller 34 an O-ring 73 is positioned in the groove 72 while in the lower roller 34, a ring 74 having a square cross section is positioned therein. The rings 73 and 74 engage the two layers of cloth 20 to assure the smooth and wrinkle free movement of the cloth along that portion of the attachment 10.

Figure 7:
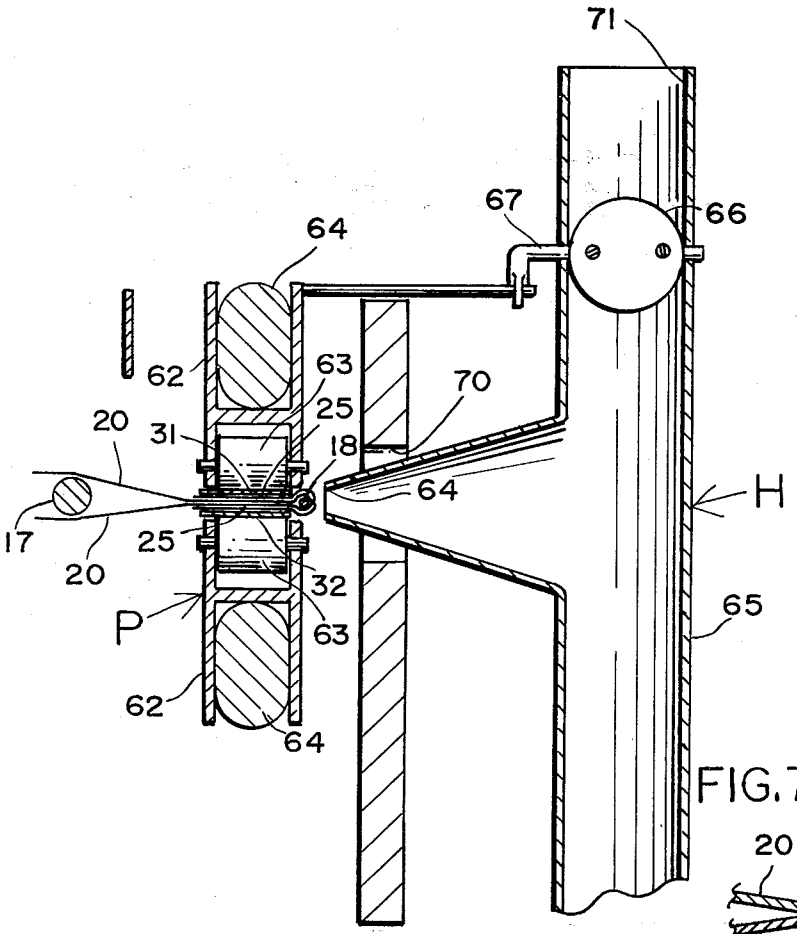

After the two plies of cloth 20 have been folded by the seam folder F, the seam plies 25 will have been swung through an arc of 180° so that they now lie on the cloth 20 as best shown by FIGS. 7 and 9. Now the cloth 20 and seam plies 25 are carried through that portion of the structure P and F which press and heat the fabric in order to set the fold. Mounted above and below the tapes 31 and 32 are rectangular shaped housings 62 mounted on the wall frame 15 and having a plurality of metallic rollers 63 that engage the tapes 31 and 32. On each side of the rollers 63 are heating elements 64 that are connected to a source of electricity (not shown) and when energized transmit heat to the rollers 63 which in turn heat the tapes 31 and 32 to press the seam plies 25. The housings 62 are so mounted on the wall 15 as to be able to shift away from and out of contact with the tapes 31 and 32 when the latter are not moving. In addition thereto, a blast of hot air is directed by an elongated nozzle 64 at the position of the tapes 31 and 32 when passing between the rollers 63. The nozzle 64 extending through an opening 70 in the wall 15 is connected to an upright pipe 65 which in turn is connected to a blower 69 of hot air. Within the pipe 65 is a valve 66 mounted on a stem 67. Hot air flows into the pipe 65 and is discharged through the nozzle 64 when the valve 66 is closed and the tapes 31 and 32 are moving and carrying the folded seams 25 along the heated rollers 63. As soon as the tapes 31 and 32 stop moving, a solenoid 68 causes the movement of housings 62 in a direction away from the tapes 31 and 32 operating a lever, which causes hot air damper 66 to be brought to its open position to discharge the hot air into the atmosphere in order that the fabric 20 will not be burned when the tapes 31 and 32 carrying the cloth 20 have stopped moving.

It will be apparent that an attachment for sewing machines has been illustrated and described in detail for sewing a seam onto two plies of cloth and folding back the two seam plies flat against the two layers of cloth, then pressing and heating the folded cloth to set the seam plies. From the above discussion it is readily noted that the operator of the sewing machine 11 need only to insert the two layers of cloth 20 between the tapes 31 and 32 at the position of the pulleys or rollers 33, one layer of cloth being positioned above the bow B and the other below the bow B. The two layers of cloth 20 are then engaged by the endless tapes 31 and 32 and carried to the position of the needle 16 where the seam is then sewn. The wire 18 and the bar 17 support the upper layer of cloth 20 as it slides therealong, while the wire 21 supports the upper layer of cloth forming the seam that extends from the stitching to the outer edge of the cloth 20. The wires 18 and 21 also guide the seam directly to the pointed end 24 of the spreader S. Note that the two separated layers of cloth 20 are not sewn together by the needle 16 until after they have passed the position of the support member 19 of the floating bar B. Therefore, both sides of the two layers of cloth can be seamed as in the production of sleeves, trousers and the like. The seamstress need only to occupy herself with the chore of operating the sewing machine 11 to sew the seam 26 in the proper position on the cloth and permit the cloth 20 to be fed properly into the attachment. As long as the sewing machine 11 is operating to sew the seam 26, the attachment will operate automatically to fold the seam plies 25 properly and press them to discharge the completed seam at the rearward end portion of the attachment. Upon the completion of sewing, folding and pressing a seam on one side of two layers of cloth to form a trouser leg, for example, the other seam on the other side of the cloth to complete the trouser leg can now be sewn, folded and pressed. The floating bow B renders it possible to sew, fold and press seams formed on both sides of a length of two superimposed layers of cloth to produce the tubular shaped article that constitutes the leg of a trouser or the arm portion of a coat.

Having disclosed my invention, what I claim as new and desire to secure by Letters Patent of the United States is:

1. A seam folding attachment for sewing machines comprising conveyor means for carrying two superimposed layers of cloth upon which a seam is sewn by the sewing machine, power operated means operating said conveyor means, supporting means mounted along said conveyor means and positioned between said layers of cloth and supporting said cloths, said supporting means having a pair of elongated members in substantially spaced parallel relation extending along said conveyor means, means securing said support means in proximity of said sewing machine at a position prior to the needle sewing said seam, said elongated members being positioned between said layers of cloth on either side of said seam, spreading means mounted on one of said elongated members in the path of said seam separating the seam plies and positioning said seam plies in a plane and substantially at right angle to that of said cloths, and folding means mounted in proximity to said spreading means folding said separated seam plies on the cloth thereby forming four superimposed layers of cloth extending from said seam.

2. The structure as recited by claim 1 taken in combination with heating and pressing means mounted along said conveyor means setting said seam plies against said layers of cloth.

3. The structure is recited by claim 1 wherein said conveying means comprises a pair of endless belt means, roller means mounting said endless belt means in substantially close and parallel relation for receiving the layers of cloth therebetween.

4. The structure as recited by claim 3 wherein said roller means at the position of said folding means are mounted remote from said layers of cloth whereby said folding means engages said layers of cloth to fold over said seam plies into contact relation with the outer surfaces of said cloths.

5. The structure as recited by claim 4 wherein said seam is sewn along one side and in close proximity to said tapes, said first wire means extending between said layers of cloth on the inside of said seam, said second wire means extending between said layers of cloth on the outside of said seam supporting said seam plies and means mounted on said belt means preventing the slipping of said cloths on said belt means.

6. The structure as recited by claim 5 wherein said power operated means comprises interengaging gears mounted on said roller means of each of said endless belt means, ratchet means mounted on one of said gears for rotational movement in one direction and cam operated means for conveying rotational power from said sewing machine to said endless belt means.

7. The structure as recited by claim 6 wherein said pressing means comprises a housing mounted above and below said tapes, a plurality of rollers mounted in said housing in close proximity to said upper and lower endless belt means and heating elements mounted in said housings adjacent said rollers whereby said rollers become heated, engage and press said seam plies against said layers of cloth.

8. The structure as recited by claim 7 wherein said heating means comprises a pipe for conveying heated air, a nozzle communicating with said pipe and mounted adjacent said endless belt means at said housings whereby heated air is directed into said fold seam.

9. The structure as recited by claim 2 wherein said supporting means comprises a substantially C-bar shaped member having leg portions, and said one of said elongated members being a wire extending from one of said leg portions and supporting the upper ply of said seam.

10. The structure as recited by claim 9 wherein the other of said elongated members being a second wire extending between said leg portions of said C-bar shaped member.

* * * * *